US006752345B2

(12) United States Patent
Betti et al.

(10) Patent No.: US 6,752,345 B2
(45) Date of Patent: Jun. 22, 2004

(54) REWINDING MACHINE AND METHOD FOR WINDING UP ROLLS OF WEBLIKE MATERIAL ON EXTRACTABLE MANDRELS

(75) Inventors: Giulio Betti, Capannori (IT); Angelo Benvenuti, Lucca (IT); Roberto Morelli, S. Maria a Colle (IT)

(73) Assignee: Fabio Perini S.p.A., Lucca (IT)

( * ) Notice: Subject to any disclaimer, the term of this patent is extended or adjusted under 35 U.S.C. 154(b) by 0 days.

(21) Appl. No.: 10/239,787

(22) PCT Filed: Mar. 23, 2001

(86) PCT No.: PCT/IT01/00145

§ 371 (c)(1),
(2), (4) Date: Sep. 25, 2002

(87) PCT Pub. No.: WO01/72620

PCT Pub. Date: Oct. 4, 2001

(65) Prior Publication Data

US 2003/0047639 A1 Mar. 13, 2003

(30) Foreign Application Priority Data

Mar. 28, 2000 (IT) ..... FI2000A0079

(51) Int. Cl.[7] ..... B65H 18/20; B65H 19/28; B65H 19/30; B08B 9/023

(52) U.S. Cl. ..... 242/532.3; 242/533.1; 242/542; 242/908; 15/256.51

(58) Field of Search ..... 242/532.3, 532.2, 242/533.1, 542, 542.1, 542.2, 908; 15/256.51, 256.52, 256.53

(56) References Cited

U.S. PATENT DOCUMENTS

| | | | | |
|---|---|---|---|---|
| 3,430,881 A | | 3/1969 | Ebneter | |
| 3,532,572 A | | 10/1970 | Herman | |
| 3,552,670 A | | 1/1971 | Herman | |
| RE28,353 E | | 3/1975 | Nystrand et al. | |
| 4,418,503 A | | 12/1983 | Dantinne | |
| 4,487,377 A | | 12/1984 | Perini | |
| 4,723,724 A | | 2/1988 | Bradley | |
| 4,828,195 A | | 5/1989 | Hertel et al. | |
| 4,856,725 A | | 8/1989 | Bradley | |
| 4,931,130 A | | 6/1990 | Biagiotti | |
| 4,962,897 A | | 10/1990 | Bradley | |
| 5,248,106 A | | 9/1993 | Biagiotti | |
| 5,368,252 A | | 11/1994 | Biagiotti | |
| 5,452,496 A | * | 9/1995 | Long et al. | 242/532.2 |
| 5,538,199 A | | 7/1996 | Biagiotti | |
| 5,639,046 A | | 6/1997 | Biagiotti | |
| 5,690,296 A | | 11/1997 | Biagiotti | |
| 5,839,680 A | | 11/1998 | Biagiotti | |
| 5,849,357 A | * | 12/1998 | Andersson | 242/532.3 |

FOREIGN PATENT DOCUMENTS

| | | |
|---|---|---|
| DE | 195 04 170 A1 | 8/1996 |
| GB | 2 105 688 | 3/1983 |
| WO | WO 94/21545 A1 | 9/1994 |
| WO | WO 99/42393 A1 | 8/1999 |

* cited by examiner

*Primary Examiner*—John M. Jillions
(74) *Attorney, Agent, or Firm*—Breiner & Breiner, L.L.C.

(57) ABSTRACT

The rewinding machine for the production of rolls of weblike material comprises: a winding-up system (1, 3, 5) for winding up the weblike material on winding-up mandrels (M), and an extractor (23) for separating the mandrels from the respective rolls formed thereon. A device for washing the mandrels is also provided.

21 Claims, 6 Drawing Sheets

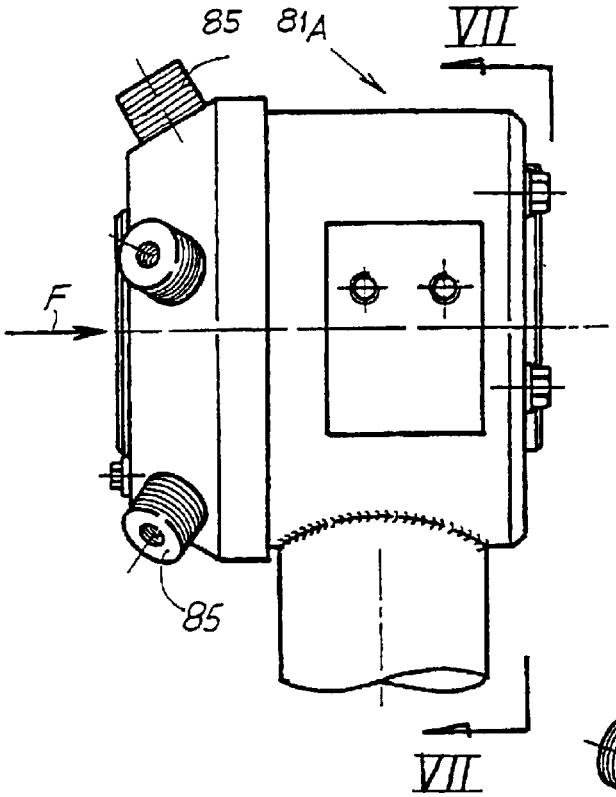
Fig. 6
Fig.7
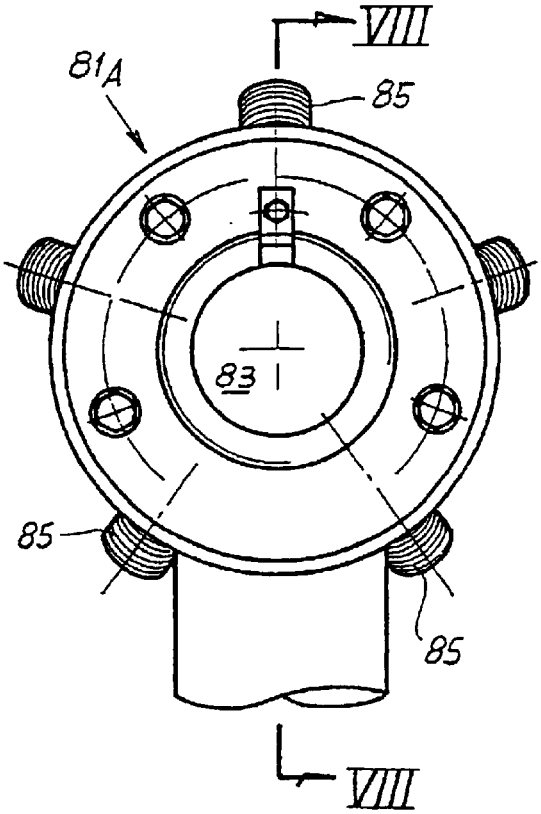
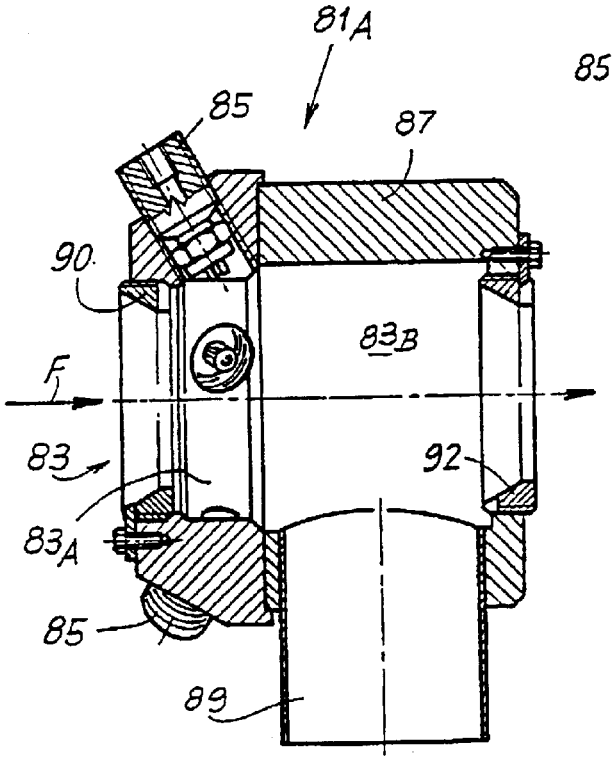
Fig.8

REWINDING MACHINE AND METHOD FOR WINDING UP ROLLS OF WEBLIKE MATERIAL ON EXTRACTABLE MANDRELS

TECHNICAL FIELD

The invention relates to a rewinding machine, in other words a machine for the production of rolls of weblike material, for example—but not exclusively—rolls of paper, tissue paper or the like, for the subsequent production of small rolls of toilet paper, kitchen towel or other products in roll form.

More specifically, the present invention relates to a rewinding machine, preferably of the type known as peripheral or surface, that is to say where the roll being formed is maintained in rotation by means of contact with peripheral winding-up members, such as rollers, belts or equivalent elements. Furthermore, the present invention relates to a rewinding machine having extractable mandrels, that is to say wherein, at the completion of winding-up, the mandrels are extracted in order to obtain a roll having no mandrel or central winding-up core.

The invention also relates to a method of winding up for the production of rolls of weblike material, typically—but not exclusively—rolls of paper, tissue paper or the like.

STATE OF THE ART

In numerous sectors of industry, and in particular in the paper converting industry, it is frequently necessary to produce rolls of wound-up weblike material, for example rolls of paper, tissue paper or the like; in other technological sectors, the need arises to produce rolls of plastic film, fabric, nonwoven fabric and other materials in web form.

Especially in the production sector of tissue paper articles, such as rolls of toilet paper, kitchen towel or similar products, from large-diameter reels, produced in paper mills, rolls or logs are produced having a diameter equal to the diameter of the product intended for the end consumer and axial lengths greater than those of the finished article. These rolls or logs are subsequently cut orthogonally to their axis to produce the small rolls intended for consumption.

For the production of rolls of this type, use is commonly made of rewinding machines of the type known as peripheral, where the roll being formed is maintained in rotation and the weblike material is fed by means of rotating members or other moveable members which are in surface contact with the exterior of the roll being formed. Examples of rewinding machines are described and illustrated in U.S. Pat. Nos. 4,723,724, 4,856,725, 4,828,195, 4,962,897, 4,487,377, 4,931,130, 5,248,106, 5,368,252, GB-A-2 105 688 and WO-A-9 421 545.

According to another technology, the rolls are wound up on motor-driven mandrels. This is referred to as central winding. Examples of this technology are described in US-RE-2 835 3, U.S. Pat. Nos. 3,430,881, 3,532,572, 3,552, 670.

Normally, the rolls are produced on a tubular cardboard core which then remains permanently within the roll and is cut together with the wound-up weblike material, so that a piece of tubular core remains in each of the individual rolls intended for the end consumer.

Special methods also exist for winding up rolls without a central core, where the finished roll takes on the appearance of a compact cylinder completely filled with weblike material. Rewinding machines which operate in accordance with this principle are described in U.S. Pat. Nos. 5,639,046, 5,690,296, 5,839,680, 5,538,199.

Winding-up systems have also been studied in which the weblike material is wound up on a central core or mandrel to form the roll from which the mandrel is subsequently extracted and recycled. This system makes it possible to operate with winding-up principles substantially similar to those used for winding up on cardboard cores, but eliminates the need to produce and consume tubular cardboard cores, with a consequent saving of materials and a reduction in the bulk of the machinery, in that the need for what are known as the "tube-makers", in other words the machines that produce the cardboard cores from strips of cardboard, is eliminated. The mandrels extracted from the finished rolls are recycled from the extraction zone, located downstream of the rewinder, to the entry of the rewinder.

In this way, it is possible to carry out continuous high-speed production with a limited number of mandrels.

In order to facilitate extraction and achieve other advantages in terms of reduction of bulk and ease of manipulation, it has been suggested that the extractable mandrels should be produced in two parts, each of which is extracted from the appropriate end of the finished roll. A machine and a method of this type are described in WO-A-99/42 393.

When the rolls are formed on extractable mandrels, appropriate measures have to be taken to ensure that the initial length of the weblike material adheres to the outer surface of the winding-up mandrel. These measures have to permit easy subsequent extraction of the mandrel once winding-up has been completed. To this end, use may be made of pneumatic systems, air blowers, electrostatic charges or the like which attract the free length to and maintain if on the surface of the mandrel, their action ceasing at a subsequent stage of the winding-up cycle.

Systems have also been examined in which the outer surface of the mandrel is soaked with water, which should provide a sufficient adhesive action for the initial free length of the weblike material which is being wound up. The water is absorbed by the weblike material in the subsequent phase of winding-up, thus permitting the subsequent extraction of the mandrel from the finished roll.

The systems currently used to anchor the free initial length of the weblike material on the extractable mandrel are not always satisfactory, in that they can be used only with certain types of material, or because they provide an adhesive effect that is not always reliable, especially at high production speeds, so that they enforce a reduced speed.

OBJECTS AND SUMMARY OF THE INVENTION

It is an object of the present invention to provide a rewinding machine and a winding method, in particular and preferably (but not exclusively) of the peripheral type on extractable winding-up mandrels, which makes it possible to achieve an effective and reliable anchoring of the free length of the weblike material on the mandrel, without obstructing or otherwise causing problems in the subsequent phases of extraction of the mandrel from the finished roll.

This and further objects and advantages, which will become apparent to persons skilled in the art from reading the text that follows, are substantially achieved with a rewinding machine for the production of rolls of weblike material, comprising: a system of winding up on winding-up mandrels for the formation of said rolls; an extractor for separating the mandrels from the respective rolls formed thereon and in which is provided at least one washing device for washing said mandrels between the separation from the rolls and the start of winding-up.

When a rewinding machine with central winding-up is used, the mandrels are moved by a revolving turret or the equivalent to various stations, which include an adhesive application station, a winding-up station and a station for drawing the roll or log off the mandrel. In this case, the washing means may be disposed in a manner such as to operate along the path of the mandrels between the station for drawing off the roll and the station for application of the adhesive, or in one of those stations. They may comprise, for example, brushes, pads or the like which pass along the axial course of the mandrel. Alternatively, they may comprise a washing box having a tubular chamber (possibly subdivided into two parts) within which the mandrel slides.

Preferably, however, the invention is embodied on a peripheral rewinding machine. In this case, advantageously, a recirculating path for the mandrels is provided between an extractor, which extracts the mandrels from the finished rolls, and a feeder, which inserts them into a winding-up cradle. The washing means are disposed in an appropriate position along the path of the mandrels.

The provision of washing of the mandrels extracted from the rolls makes it possible, first, to eliminate from the surface of the mandrels any residues of paper or other material that may continue to adhere to the mandrel after extraction.

The presence of the washing system makes it possible, and particularly advantageous, to use an adhesive to cause the initial free length of the weblike material to adhere reliably and quickly to the mandrel at the start of the winding-up of each roll. Any residue of adhesive on the extracted and recycled mandrel can be removed by means of the washing system.

The washing system makes it possible to use extractable mandrels in a traditional rewinder, in other words one designed to operate with tubular cardboard cores and the use of adhesive. It is thus possible to convert existing machines with minor modification operations. It is also possible to produce machines that can operate either with extractable mandrels or with tubular cores of cardboard (or other material) intended to remain within the finished product.

This is not possible in the absence of a washing system, since in that case debris would accumulate on the extractable mandrels.

It is not, however, necessary for the mandrels to be washed during each winding-up cycle. It would be possible, for example, to provide for washing every "N" winding-up cycles, where "N" depends, for example, on the type of adhesive and of weblike material.

Washing may take place by means of a washing fluid, for example water or water with added detergents, or even by means of a vapour, for example saturated steam, or by means of any other appropriate (liquid or gaseous) fluid.

The adhesive is preferably applied to the mandrel before insertion thereof into the zone where it comes into contact with the weblike material. However, the possibility is not ruled out that the adhesive is applied to the weblike material in the zone thereof intended to come into contact with the winding-up mandrel.

The washing device may be produced in various ways. For example, provision may be made to unload the mandrels into a tank containing a washing liquid, for example even ordinary water, with the possible addition of a detergent or a solvent. A stirrer may be provided to cause movement of the mandrels in the tank and facilitate the removal of the debris and residues of adhesive. Alternatively, brush means or other mechanical means may be provided which act on the surface of the mandrels located in the tank. From here, the mandrels can be extracted and transported into the winding-up zone, with or without a previous drying phase.

In general, the mandrels may be produced in a single piece or in two pieces that can be coupled and uncoupled. Washing may be performed either on the mandrels in a single piece or on the mandrels in two pieces, or possibly on the two separate pieces which are subsequently coupled or placed side by side (after washing) to form the mandrel. The possibility is not ruled out that the mandrels are produced in more than two pieces. When the pieces into which the mandrel is subdivided are washed separately, two washing devices may be provided, or a single washing device may be provided in which the various parts into which the mandrels are subdivided come together to be washed.

According to a particularly advantageous embodiment of the invention, the washing device comprises at least one tubular washing chamber through which the mandrels or parts thereof are passed and in which washing members are disposed. These washing members may be of various types and are preferably disposed in a circular arrangement to act on the entire surface of the mandrels or parts of mandrels which pass through the tubular chamber. For example, brushes or washing pads of annular shape may be provided, if appropriate associated with dispensers for a liquid or other washing fluid disposed upstream or in the same position as the brushes or pads. Preferably, however, the washing members are produced in a manner such as to have no mechanical contact with the surface of the mandrels or parts of mandrels. In a particularly advantageous embodiment, the latter comprise a series of nozzles which spray a liquid under pressure or blow a gaseous medium. In this way, no friction force is exercised on the mandrels or mandrel parts which could make it difficult for them to move forward. The nozzles may even be oriented in a manner such that the jet generated thereby helps to drive the mandrels or parts thereof forward. The possibility is not ruled out that the washing means are of the contact type, but equipped with a movement system, in a manner such as to generate a thrust in the forward direction of the mandrels. However, a solution of this type is more complex and less efficient from the standpoint of removal of the debris from the surface of the mandrels.

Although as a matter of principle it is possible to introduce the washed mandrels into the rewinding machine even without drying them, in particular when the washing fluid is a liquid, according to a preferred embodiment of the invention drying systems are provided which may be disposed, for example, within the chamber in which the mandrels or parts thereof pass. The drying system may comprise mechanical members, for example of absorbent material, which touch the surface of the mandrels or parts thereof. Preferably, however, for drying as well, a system is preferred that does not touch the surface of the mandrels, for example a suction member acting on the surface of the mandrels or parts of mandrels passing through the washing chamber.

Further advantageous possible features of the machine and method according to the invention are indicated in the appended claims and will be described in detail with reference to a possible form of embodiment.

BRIEF DESCRIPTION OF THE DRAWINGS

The invention will be better understood from the description and the attached drawing, which shows a practical, non-limiting example of said invention. In the drawing:

FIG. 6 shows a lateral view of one of the two washing systems for the mandrels;

FIG. 7 shows a frontal view along the line VII—VII in FIG. 6; and

FIG. 8 shows a longitudinal section along the line VIII—VIII in FIG. 7.

DETAILED DESCRIPTION OF A PREFERRED EMBODIMENT OF THE INVENTION

Figure 1:
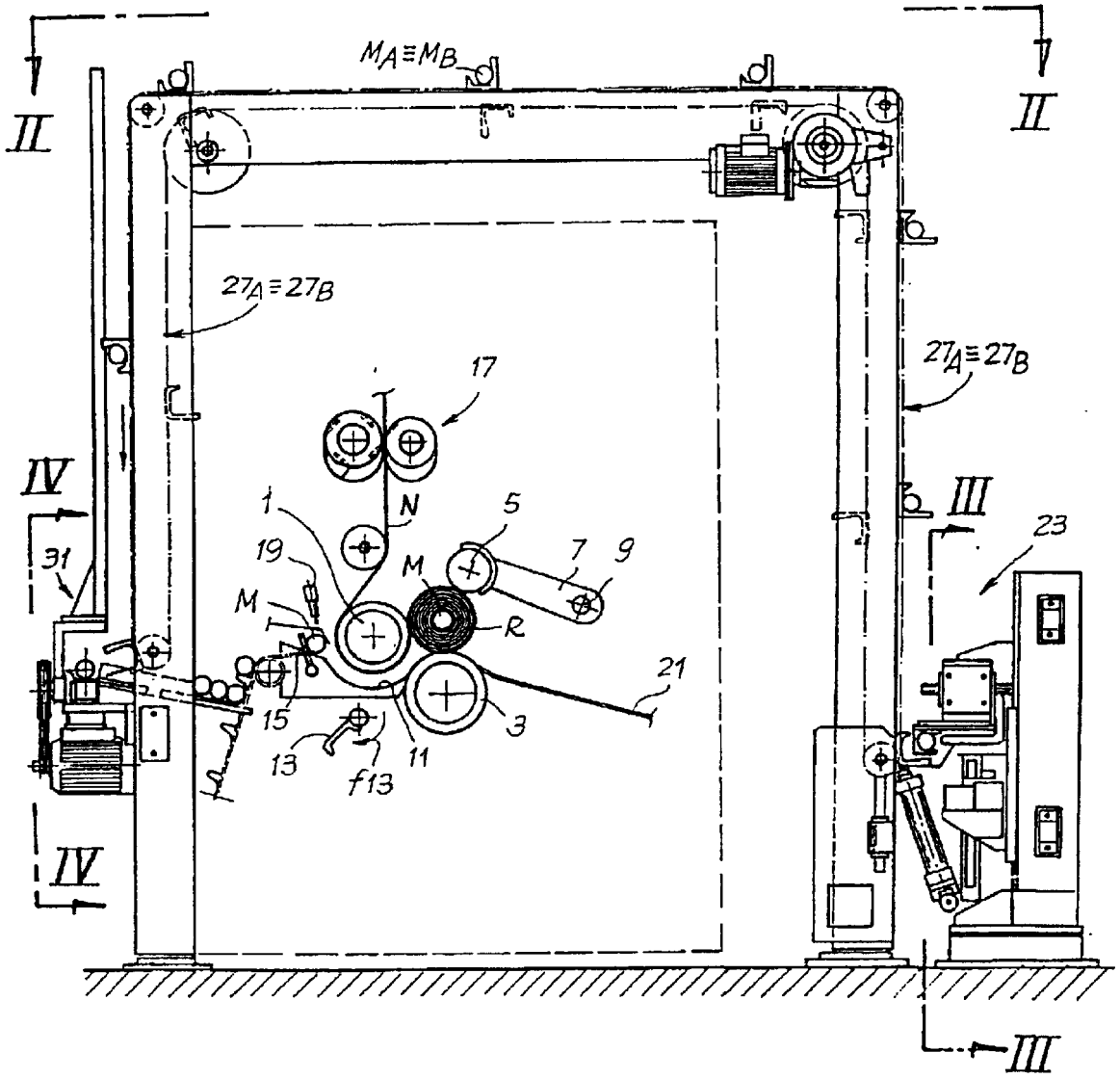
FIG. 1 shows a diagrammatic lateral view of a rewinding machine according to the invention.
Figure 2:
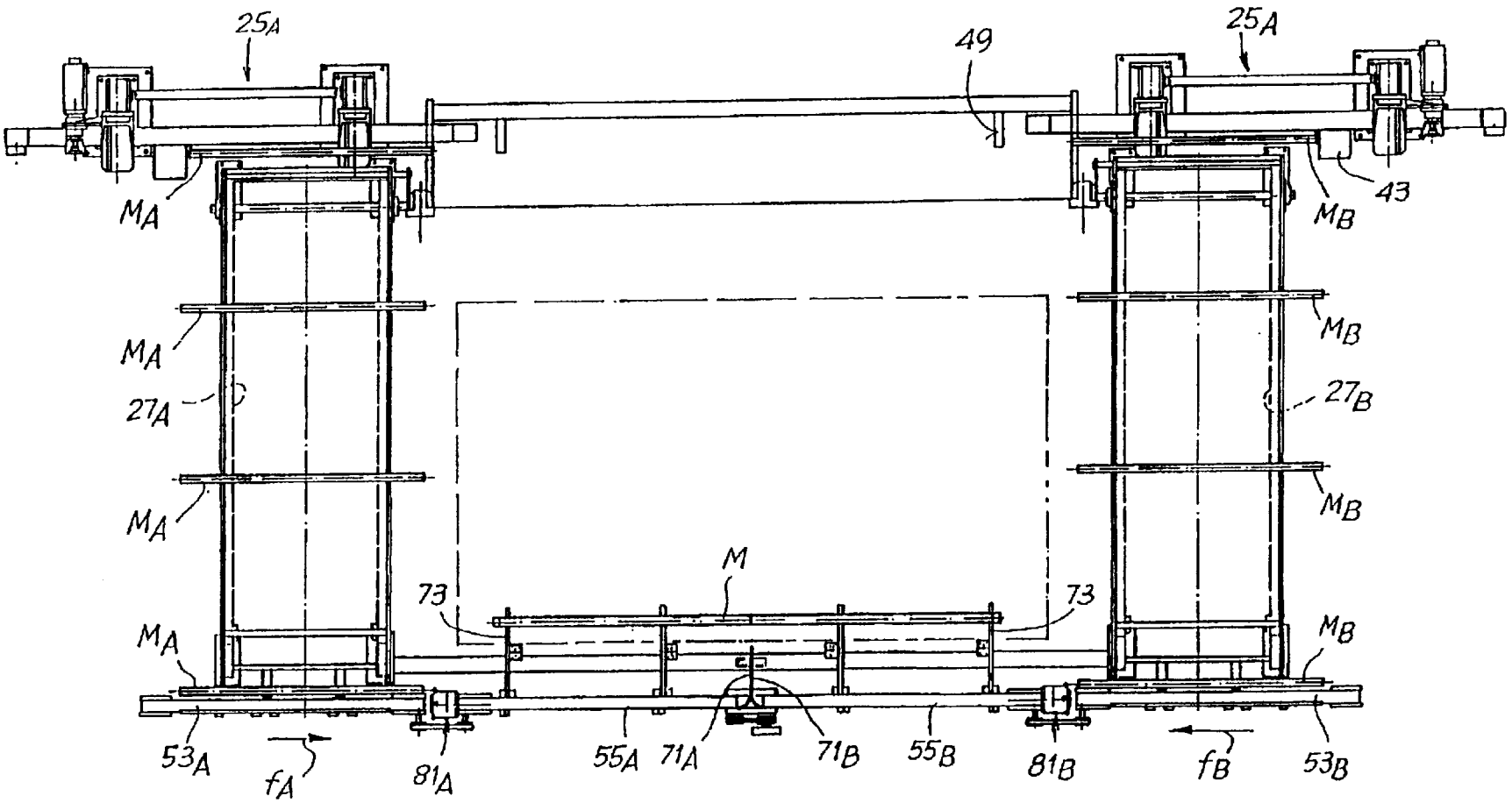
FIG. 2 shows a plan view along the line II—II in FIG. 1.

FIGS. 1 and 2 show, generally and diagrammatically, a rewinder according to the invention, confined to the general parts of the machine. The winding-up members are shown indicatively, being confined to what is necessary for an understanding of the invention. More specifically, in the embodiment shown, the winding-up members are of the peripheral type with three winding-up rollers designated 1, 3 and 5. The rollers 1, 3 and 5 define a winding-up zone where the rolls or logs R are formed. The winding-up roller 5 is mounted on an arm 7 pivoted at 9 and oscillating in order to follow the growth of the roll R being formed. Between the winding-up rollers 1 and 3 a nip is defined through which passes the weblike material which is wound up on the roll R when the latter is in contact with the trio of rollers 1, 3 and 5. The weblike material, designated N, is fed around the first winding-up roller 1.

In front of the nip formed by the winding-up rollers 1 and 3 is disposed a rolling surface 11 formed by a comb-type structure and defining, together with the cylindrical surface of the winding-up roller 1, a channel for the insertion and advancement of the winding-up mandrels. Below the rolling surface 11 is a means 13 for severing the weblike material, which rotates at appropriate times about its own axis in the direction of the arrow f13 to perform the severing of the weblike material and create the final length of the roll R and the initial length which will adhere to the subsequent winding-up mandrel which is being inserted into the machine.

The winding-up mandrels are introduced into the machine by means of a revolving feeder 15 whose movement is synchronized with that of the severing means 13, which in turn is synchronized with the movement of a perforator unit 17, in a manner such that the weblike material is severed along one of the lines of perforation generated by the perforator 17.

The winding-up means, the means of introducing the winding-up mandrels and the means of severing the weblike material briefly described here are substantially equivalent to those described in greater detail in WO-A-94/21 545, to which reference is made for further details of the functioning of the winding-up means, the means for severing the weblike material and the perforation means. The structure of the winding-up means can, of course, be different from that briefly described above, since in general the present invention can be implemented with any peripheral system of winding-up on a tubular winding-up core or mandrel.

The winding-up mandrels, designated M, are provided with gluing points, gluing taking place by means of nozzles or guns for the application of adhesive, designated 19 and disposed in series along the transverse extent of the machine, so that a sufficient quantity of adhesive is distributed over the entire axial extent of each mandrel M which is presented for introduction into the winding-up zone so as to cause the initial free length of the weblike material to adhere in order thus to commence the winding-up of a roll. The adhesive may be applied continuously or by zones or at isolated points.

The rolls R formed in the winding-up zone described above are caused to roll on a chute 21 until they arrive at an extraction station, generally designated 23, where the individual mandrels M are extracted by means of extractor members which will be described in greater detail with reference to FIG. 3.

The mandrels are produced, in a manner known per se (see WO-A-99/42 393) in two portions which are coupled before the winding-up begins thereon and which are then each extracted from one end of the roll R in the extraction station 23 to be recycled into the insertion zone.

As can be seen in the plan view of FIG. 2, the extraction station possesses two extractors 25A and 25B disposed on the two sides of the machine, which extract the two portions MA and MB of which the winding-up mandrels M are formed. The two portions MA and MB of the mandrels are then removed from the extraction station 23 by means of two chain conveyors 27A and 27B (see, in particular, FIG. 1) which transfer the individual mandrel portions to a mandrel washing and recoupling zone, designated 31 and disposed upstream of the winding-up means 1, 3 and 5.

The conveyors 27A and 27B, which in the example illustrated are formed by chains bearing cradles appropriately shaped to retain mandrel portions MA, MB of various sizes, may be replaced by other means of recirculating the mandrels, for example chutes or rolling surfaces extending laterally to the rewinding machine.

The two extractors 25A and 25B which provide for the extraction from the finished roll of the two mandrel portions MA and MB have a symmetrical structure, and only one of them will be described in more detail with reference to FIG. 3. The extractor possesses a support 33 with a horizontal sliding guide 35, along which moves a carriage 37 whose alternating movement in the direction of the double arrow f37 is controlled by a motor drive 39 by means of appropriate transmission members, represented in the example shown in the drawing by a belt 41 linked in an intermediate position to the carriage 37.

The position of the sliding guide 35 may be adjusted in the vertical direction according to f35 to adapt to the various sizes of rolls that may be produced by the rewinding machine.

The carriage 37 bears, mounted to overhang, a jaw 43 which engages the portions MA, MB forming the mandrels M in line with the respective end thereof projecting from the roll R. The jaw 43 has two expansion members 45 which engage in annular projections MR produced within the cylindrical surface of the mandrels M.

By means of appropriate control means, the expansion members 45 can be moved apart and brought together to engage on and disengage from the portion MA or MB of the mandrel M. When the jaw 43 is engaged on the portion MA or MB of the mandrel M on which the roll R is formed, the left-to-right movement in FIG. 3 of the carriage 37 causes the extraction of the mandrel portion MB from the roll R, the latter being maintained in an axial position by means of a ledge 49 provided in the extraction zone 23.

Figure 3:
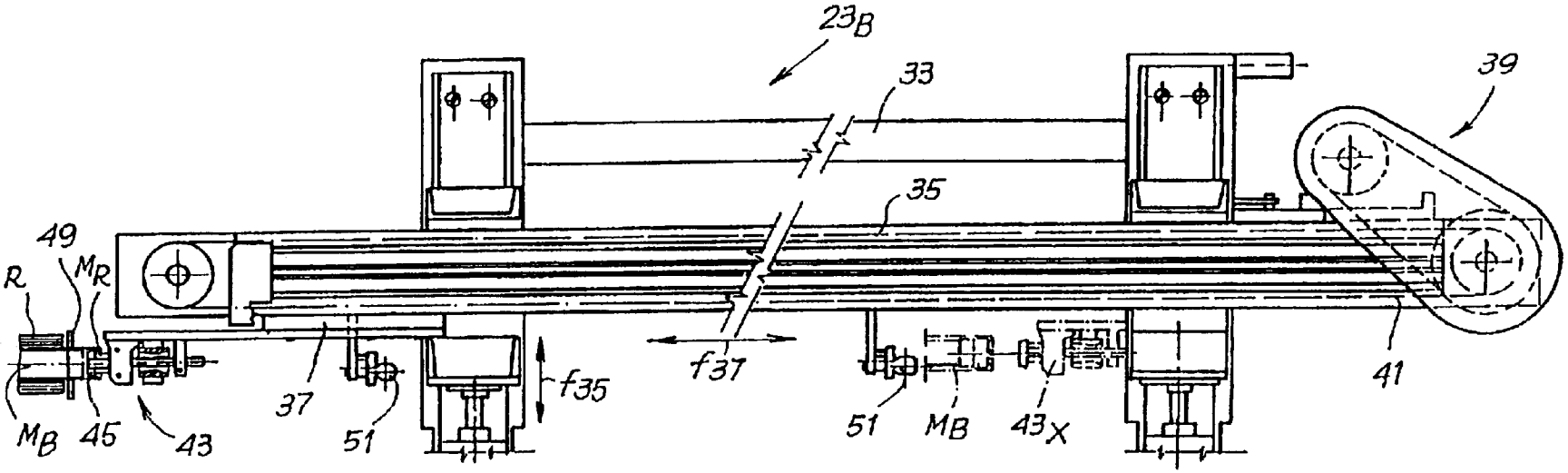
FIG. 3 shows a local lateral view along the line III—III in FIG. 1 of the system for extracting a portion of mandrel.

FIG. 3 shows in broken lines the final position, designated 43X, which is assumed by the jaw 43 when the mandrel portion MB is completely drawn out from the roll R. In this position, the expansion members 45 have been released by the mandrel portion MB, which is thus supported on two intermediate supports 51 and released by the jaw 43.

Once relinquished on the support 51, the mandrel portion MB can be picked up by the cradles provided on the respective conveyor 27 to be carried into the washing and recoupling zone 31.

The washing and recoupling zone 31 is illustrated in detail in FIGS. 2 and 4 to 8. In this zone, movement devices are provided, for example in the form of four conveyors, represented in the example shown by an equal number of aligned conveyor belts, designated 53A, 55A and 53B, 55B. The conveyor belts 53A, 55A and 53B, 55B are disposed symmetrically relative to a vertical plane of symmetry of the production line. They are controlled by a common motor 57 by means of a pulley 59 and a belt 61. With an appropriate arrangement of transmission pulleys and belts, generically designated 63A and 63B, the motor 57 controls the movement of the conveyor belts 53A and 55A in the direction of the arrow fA and, in the opposite direction, in the direction of the arrow fB, the conveyor belts 53B and 55B.

With this arrangement, the mandrel portions MA and MB which are unloaded from the conveyors 27A and 27B onto the conveyor belts 53A and 53B are moved together axially in pairs and moved into abutment against a pair of sections 71A and 71B placed in a central position relative to the conveyor belts 53A, 53B and 55A, 55B. From here, the two mandrel portions MA and MB are unloaded, by virtue of the curvature of the sections 71A and 71B, and caused to roll on inclined bars 73 until they abut against the chains 77 of a conveyor.

From here, the individual mandrel portions MA, MB are taken by means of a chain conveyor 77 which bears pick-up members 79 and are transferred in the direction of the arrow f77 toward the adhesive applicator nozzles 19 (see FIG. 1).

In an intermediate position along the path of the mandrel portions MA, MB from the conveyor belts 53A, 55A and 53B, 55B toward the nozzles 19, axial thrust means are provided which bring about the recoupling of the portions MA and MB to form a complete mandrel M which is then inserted into the winding-up zone of the rewinding machine. These coupling means may comprise, for example, pneumatic, hydraulic or other cylinders, for example converging, shaped lateral walls against which the outer ends of the portions MA, MB of the mandrels are forced during their advance. The thrust exercised by the lateral walls causes the two mandrel portions to be axially moved together and coupled. In a manner known per se, the ends of the mandrel portions that are intended to be coupled may be appropriately shaped, for example with male and female coupling surfaces, of frustoconical or other shape. It is also possible to provide for the two portions merely to be placed side by side.

Figure 4A:
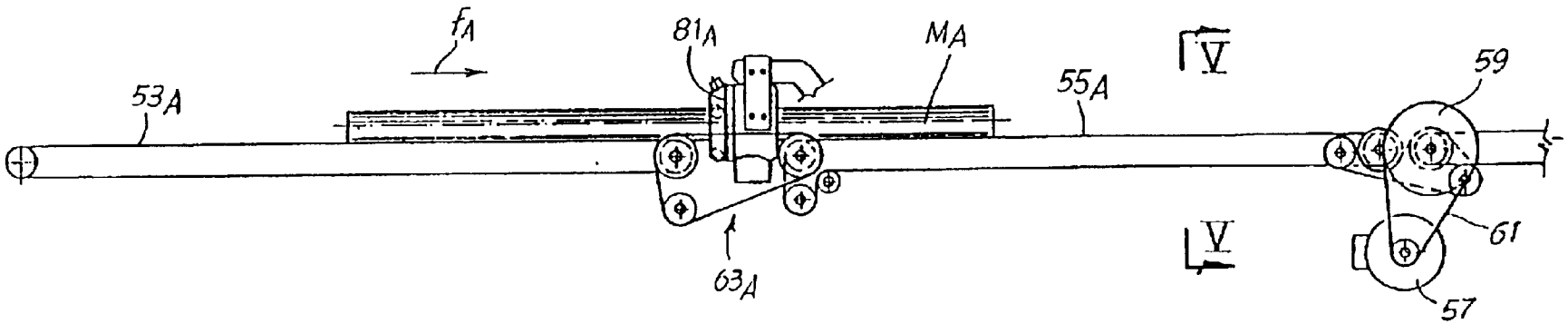
FIGS. 4*a* and 4*b* show an enlarged local view along the line IV—IV in FIG. 1.
Figure 4B:
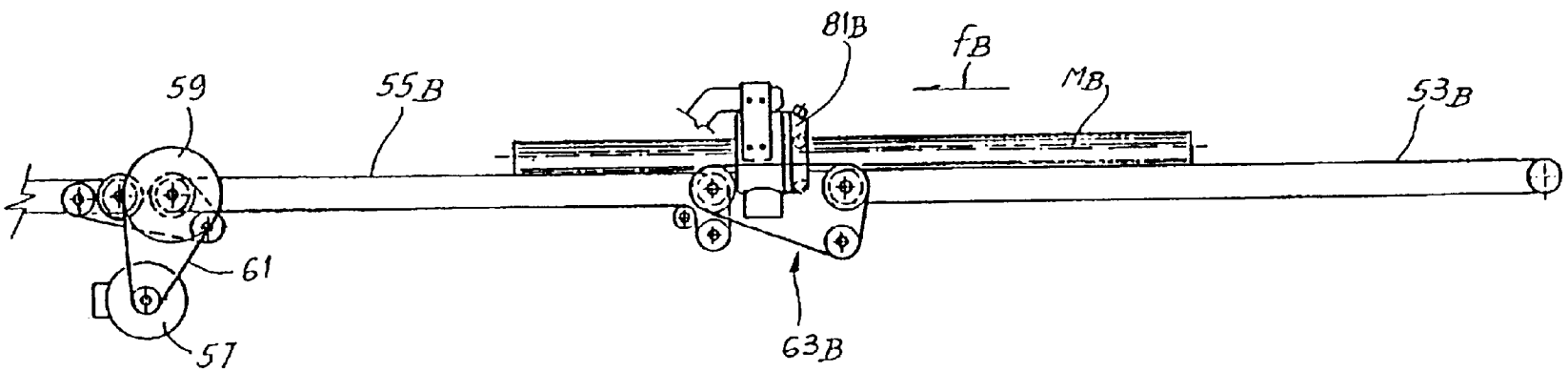
Figure 5:
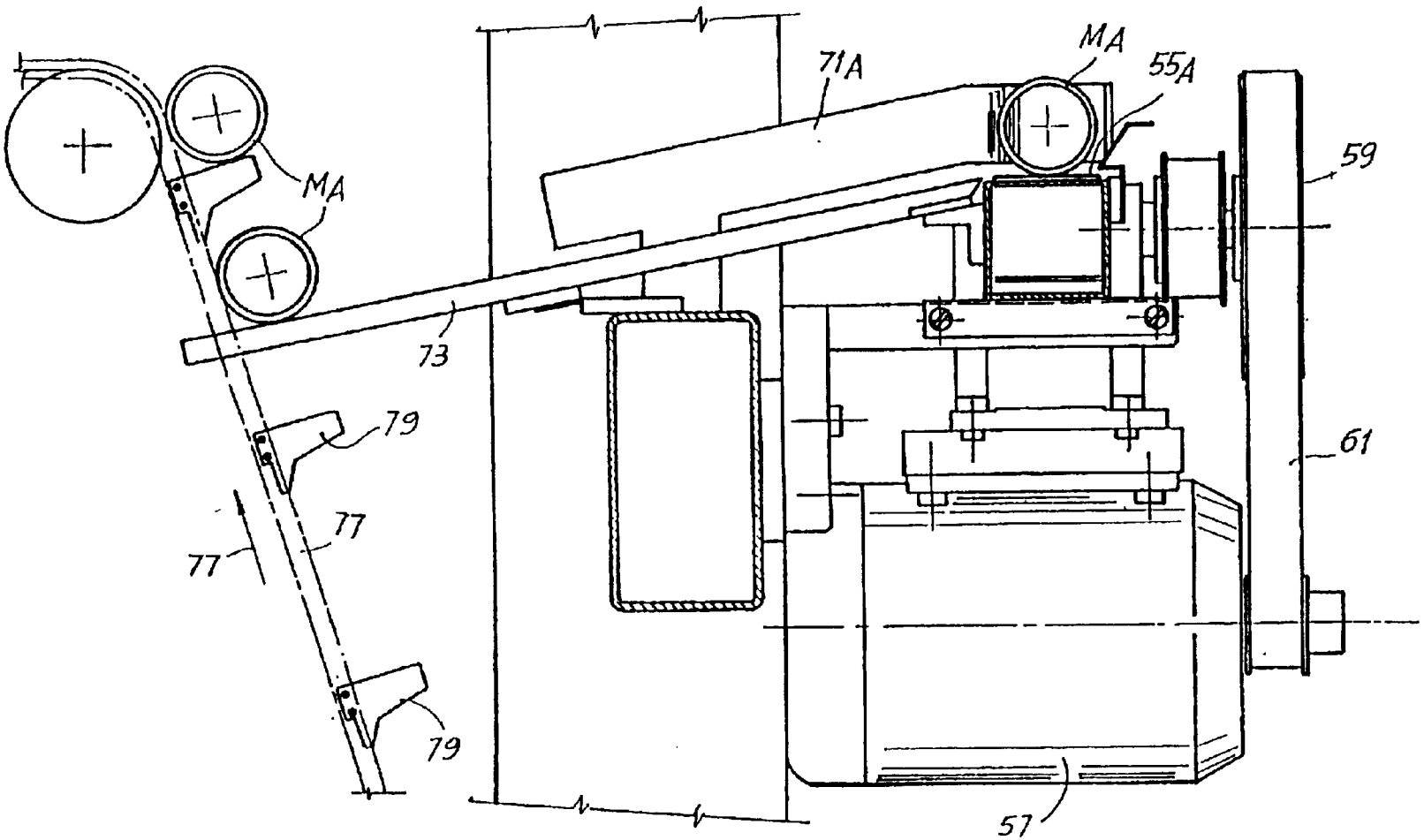
FIG. 5 shows a section along the line V—V in FIG. 4.

As can be seen in particular in FIGS. 2 and 4, two washing units designated 81A and 81B are disposed between the conveyors 53A and 55A on the one hand and between the conveyors 53B and 55B on the other hand.

The two washing units 81A and 81B are substantially symmetrical, and only the unit 81A will be described below, being shown in more detail in FIG. 8. This possesses a tubular chamber 83, in other words a chamber with a through axial aperture. The chamber 83 is defined by a first portion 83A delimited by a collar 85 along whose annular extent dispenser nozzles for a washing liquid are disposed.

In the example shown in the figure, five dispenser nozzles 85 are provided, uniformly disposed along the annular extent of the device. The portion 83A of the tubular chamber is followed by a portion 83B, delimited by a sleeve 87. The portion 83B is connected, via an aperture in the sleeve 87, to a suction duct 89. A suction space is thus formed, through which the mandrel portions pass. The mandrel portion MA enters into the tubular chamber 83 in the direction of the arrow F shown in FIG. 8 and exits from the opposite part having passed through the two portions 83A and 83B of the tubular chamber 83. The inlet aperture of the tubular chamber 83 is delimited by a ring 90, while the outlet aperture is delimited by a ring 92.

The nozzle-type dispensers 85 are connected by means of flexible pipes (not shown) to a pump or other means of dispensing washing liquid under pressure, while the suction duct 89 is connected to a vacuum source. With this arrangement, the passage of the mandrel portions through the tubular chamber 83 causes the entire surface of the mandrel portion to be subjected, during movement in the direction of the arrow F, to the jets of washing liquid generated by the nozzle-type dispensers 85. The surface is subsequently dried by means of the suction generated via the suction duct 89. The rings 90, 92 provide a guide for the portions MA and MB and have a size such as to permit the entry of air which performs the drying.

The machine hitherto described operates as follows.

Individual mandrels M formed from portions MA and MB, coupled or placed side by side axially, are introduced at appropriate moments into the channel defined by the first winding-up roller 1 and by the rolling surface 11 after having received on their own surface a sufficient quantity of adhesive applied by means of the sprayer nozzles 19 or in another suitable manner, for example by means of pads, by means of dipping rollers from a tank or other means. From this time until the completion of the winding-up of the individual roll R on the mandrel M, the operation of the rewinding machine is identical to that of the conventional rewinding machines and in particular (in the example shown) to the operation described in WO-A-94/21 545.

The individual rolls R formed are unloaded into the extraction station 23, where the two jaws (one of which is shown in FIG. 3 and designated 43 therein) grip from opposite sides the projecting ends of the portions MA and MB forming each mandrel and cause their extraction. The two portions MA and MB are carried by the extraction jaws 43 in alignment with the two lateral conveyors 27A and 27B which pick up the mandrel portions MA and MB and convey them to the entry zone of the rewinding machine, eventually carrying them onto the conveyor belts 53A and 53B.

Here, by means of movement of the conveyor belts 53A, 55A and 53B, 55B, each mandrel portion MA, MB is caused to pass through the respective washing unit 81A, 81B. By virtue of the configuration of the washing unit 81A, 81B described above, any residues of adhesive or other impurities to be found on the cylindrical surface of the mandrel portions MA and MB are removed, so that the mandrel portions MA and MB are completely cleaned and dried when situated on the conveyor belts 55A and 55B. From here, they are again conveyed into the entry zone of the channel defined by the winding-up roller 1 and by the rolling surface 11, having first been axially coupled to one another, in order to begin a new winding-up cycle.

It is understood that the drawing shows only a simplification, given solely as a practical demonstration of the invention, said invention being capable of being varied in shapes and configurations without thereby departing from the scope of the idea underlying said invention.

What is claimed is:

1. A rewinding machine for producing rolls of web-like material comprising:

a winding-up system for winding web-like material on winding-up mandrels, said winding-up system including a winding-up cradle;

an extractor for separating the mandrels from rolls of the web-like material formed on the mandrels;

at least one washing device for washing the mandrels, a feeder for introducing the winding-up mandrels to said cradle, and a recirculating path for transferring said mandrels from the extractor to the feeder along which is provided said at least one washing device.

2. A rewinding machine for producing rolls of web-like material comprising a winding-up system for winding web-like material on winding-up mandrels;

an extractor for separating the mandrels from rolls of the web-like material formed on the mandrels;

a feeder for introducing the mandrels to said winding-up system;

a recirculating path for transferring the mandrels from the extractor to the feeder;

at least one washing device along said recirculating path, said at least one washing device for washing said mandrels.

3. The rewinding machine as claimed in claim 1 or 2, further comprising an adhesive applicator for applying an adhesive to cause adhesion of the web-like material to said mandrels and initiate winding-up of the web-like material.

4. The rewinding machine as claimed in claim 1 or 2, wherein said washing device comprises at least one tubular washing chamber through which said mandrels or parts of said mandrels are passed, and washing members disposed in said chamber.

5. The rewinding machine as claimed in claim 4, wherein said washing members comprise washing fluid dispensers.

6. The rewinding machine as claimed in claim 5, further comprising a drying system associated with said chamber.

7. The rewinding machine as claimed in claim 5, wherein said dispensers comprise spraying nozzles disposed in an annular manner about a transit zone of said mandrels or parts of said mandrels.

8. The rewinding machine as claimed in claim 6, wherein said drying system comprises a suction member acting on a surface of the mandrets or parts of the mandrels in transit through said chamber.

9. The rewinding machine as claimed in claim 8, wherein said suction member comprises a suction space through which said mandrels or parts of the mandrels pass.

10. The rewinding machine as claimed in claim 4, further comprising a movement device for moving said mandrels or parts of the mandrels through said tubular washing chamber.

11. The rewinding machine as claimed in claim 10, wherein said movement device comprises a conveyor upstream and a conveyor downstream of said tubular washing chamber.

12. The rewinding machine as claimed in claim 1 or 2, wherein said mandrels individually comprise two parts that can be coupled and uncoupled;

said extractor separately extracts each of the two parts forming each mandrel from two opposite ends of each respective roll;

said recirculating path is dual in order to recirculate separately each part of the two parts constituting each mandrel;

the washing device is dual, one washing device being provided for each recirculating path, one of the two parts forming each mandrel passing through each washing device, said two parts subsequently being brought together to form the mandrel.

13. A method of winding up for producing rolls of web-like material comprising phases of:

winding a roll of web-like material onto a winding-up mandrel;

separating the mandrel from the roll formed:

winding up a subsequent roll on said mandrel, providing a recirculating path for recirculating said mandrel, and washing said mandrel along said recirculating path before said subsequent roll is wound up thereon.

14. Method of winding up for producing rolls of web-like material comprising inserting a winding-up mandrel into a winding-up cradle;

winding-up a roll of web-like material on said mandrel;

unloading the roll with the respective mandrel from the winding-up cradle;

extracting said mandrel from the roll;

recycling the winding-up mandrel to the winding-up cradle along a recirculating path in order to form a subsequent roll thereon;

washing said winding-up mandrel along said recirculating path before reintroducing the mandrel into the winding-up cradle.

15. Method as claimed in claim 13 or 14, further comprising applying an adhesive in order to anchor on said mandrel an initial length of the web-like material to initiate the winding-up of the roll, wherein any residues of adhesive are removed from the winding-up mandrel by said washing.

16. The method as claimed in claim 13 or 14, wherein said mandrel is dried after washing.

17. The method as claimed in claim 16, wherein said mandrel is dried by suctioning off any residual washing fluid on the mandrel.

18. The method as claimed in claim 13 or 14, further comprising at least one tubular washing chamber through which said mandrel or a part of said mandrel is passed.

19. The method as claimed in claim 18, wherein a drying system is associated with said tubular chamber.

20. The method as claimed in claim 19, further comprising a suction space in said tubular chamber through which said mandrel or a part of the mandrel is passed and dried by suction.

21. The method as claimed in claim 13 or 14, wherein said mandrel comprises two parts;

said two parts are coupled and the roll is wound up on the mandrel;

said two parts are extracted separately from opposite ends of the roll;

said two parts are washed separately; and said two parts are recoupled in order to wind up a subsequent roll.

* * * * *